US010450688B2

(12) United States Patent
Poy et al.

(10) Patent No.: US 10,450,688 B2
(45) **Date of Patent: *Oct. 22, 2019**

(54) CONTINUOUS BATCH TUNNEL WASHER AND METHOD

(71) Applicant: PELLERIN MILNOR CORPORATION, Kenner, LA (US)

(72) Inventors: Russell H. Poy, New Orleans, LA (US); Samuel Garofalo, Charlotte, NC (US)

(73) Assignee: PELLERIN MILNOR CORPORATION, Kenner, LA (US)

( * ) Notice: Subject to any disclaimer, the term of this patent is extended or adjusted under 35 U.S.C. 154(b) by 330 days.

This patent is subject to a terminal disclaimer.

(21) Appl. No.: 15/440,912

(22) Filed: Feb. 23, 2017

(65) Prior Publication Data

US 2017/0233922 A1 Aug. 17, 2017

Related U.S. Application Data

(60) Continuation of application No. 13/899,249, filed on May 21, 2013, now Pat. No. 9,580,854, which is a (Continued)

(51) Int. Cl.
*D06F 31/00* (2006.01)
*D06F 35/00* (2006.01)
(Continued)

(52) U.S. Cl.
CPC ..... *D06F 31/005* (2013.01); *D06F 35/005* (2013.01); *D06F 39/022* (2013.01);
(Continued)

(58) Field of Classification Search
CPC ..... D06F 31/005; D06F 35/005; D06F 31/00; D06F 35/006; D06F 33/02; D06F 2232/00
(Continued)

(56) References Cited

U.S. PATENT DOCUMENTS 1,686,313 A 10/1928 Dreher et al.
2,647,388 A 8/1953 Scheele
(Continued)

FOREIGN PATENT DOCUMENTS

CN 2256430 Y 6/1997
DE 10312163 A1 11/2003
(Continued)

*Primary Examiner* — Michael E Barr
*Assistant Examiner* — Thomas Bucci
(74) *Attorney, Agent, or Firm* — Garvey, Smith & Nehrbass, Patent Attorneys, L.L.C.; Charles C. Garvey, Jr.; Vanessa M. D'Souza

(57) ABSTRACT

A method of washing fabric articles in a tunnel washer includes moving the fabric articles from the intake of the washer to the discharge of the washer through first and second sectors that are a pre-wash zone. Liquid can be counter flowed in the wash interior along a flow path that is generally opposite the direction of travel of the fabric articles. The main wash zone can be heated as an option. In the wash zone, there is a pre-rinse and/or a rinse. The fabric articles are transferred to a water extraction device that enables removal of excess water. A sour solution can be added to the fabric articles while extracting excess water.

34 Claims, 8 Drawing Sheets

Related U.S. Application Data division of application No. 12/765,500, filed on Apr. 22, 2010, now Pat. No. 9,127,389.

(60) Provisional application No. 61/298,818, filed on Jan. 27, 2010, provisional application No. 61/171,682, filed on Apr. 22, 2009.

(51) Int. Cl.
*D06F 39/02* (2006.01)
*D06F 39/04* (2006.01)
*D06F 39/08* (2006.01)
*D06F 33/02* (2006.01)

(52) U.S. Cl.
CPC ..... *D06F 39/04* (2013.01); *D06F 39/085* (2013.01); *D06F 39/088* (2013.01); *D06F 31/00* (2013.01); *D06F 33/02* (2013.01); *D06F 2232/00* (2013.01)

(58) Field of Classification Search
USPC ..... 8/159, 158, 151, 137; 68/27, 58, 205 R, 68/5 D, 207, 140, 143, 142, 9; 134/64 R, 134/10, 111, 26, 108, 115 R
See application file for complete search history.

(56) References Cited

U.S. PATENT DOCUMENTS 3,722,233 A 3/1973 Windhorst
3,918,112 A * 11/1975 Seibt ..... D06F 39/006 8/158
4,210,004 A * 7/1980 Stoll ..... D06F 31/005 68/27
4,236,393 A * 12/1980 Katzfey ..... D06F 31/005 68/27
4,363,090 A 12/1982 Garcia
4,478,060 A * 10/1984 Grunewald ..... D06F 31/005 68/27
4,479,370 A 10/1984 Wang
4,485,509 A * 12/1984 Pellerin ..... D06F 31/005 68/27
4,519,224 A * 5/1985 Seifert ..... D06F 31/005 68/143
4,522,046 A 6/1985 Dreher
4,546,511 A * 10/1985 Kaufmann ..... D06F 31/005 134/107
4,607,509 A * 8/1986 Stoll ..... D06F 31/005 68/27
4,616,372 A * 10/1986 Stoll ..... D06F 31/005 8/158
4,694,665 A * 9/1987 Stoll ..... D06F 31/005 68/27
4,848,107 A * 7/1989 Stoll ..... D06F 31/005 68/27
4,879,887 A * 11/1989 Kagi ..... D06F 31/005 68/16
5,211,039 A * 5/1993 Pellerin ..... D06F 31/005 68/140
5,333,475 A * 8/1994 Edmundson ..... D06F 31/005 68/139
5,392,480 A * 2/1995 Ishihara ..... D06F 31/005 68/145
5,426,958 A * 6/1995 Sheppard ..... D06F 31/005 68/142
5,454,237 A * 10/1995 Pellerin ..... D06F 31/005 68/143
5,487,283 A * 1/1996 Sheppard ..... D06F 31/005 68/142
6,277,153 B1 * 8/2001 Van Kouwen ..... C11D 3/386 510/277
6,681,429 B2 * 1/2004 Mehrmann ..... D06F 31/005 68/145
7,089,620 B2 * 8/2006 Stoll ..... D06F 31/005 68/27
7,971,302 B2 * 7/2011 Poy ..... D06F 31/005 8/137
8,225,445 B2 * 7/2012 Bringewatt ..... D06F 35/006 8/159
8,336,144 B2 * 12/2012 Poy ..... D06F 31/005 8/137
8,370,981 B2 * 2/2013 Poy ..... D06F 31/005 8/137
9,127,389 B2 * 9/2015 Poy ..... D06F 31/005
9,580,854 B2 * 2/2017 Poy ..... D06F 31/005
2002/0038481 A1 * 4/2002 Stoll ..... D06F 31/005 8/158
2002/0116770 A1 8/2002 Mehrmann et al.
2003/0110576 A1 * 6/2003 ten Have ..... D06F 31/005 8/158
2003/0110815 A1 * 6/2003 Poy ..... D06F 31/005 68/27
2005/0257576 A1 * 11/2005 Omura ..... D06F 35/006 68/12.05
2009/0249560 A1 10/2009 Gaulter et al.
2009/0255145 A1 10/2009 Poy
2009/0260161 A1 * 10/2009 Poy ..... D06F 31/005 8/115.6
2009/0260162 A1 * 10/2009 Poy ..... D06F 31/005 8/115.6
2010/0269267 A1 * 10/2010 Poy ..... D06F 31/005 8/159
2011/0011136 A1 * 1/2011 Wientjens ..... C09K 8/5083 68/15
2011/0173761 A1 7/2011 Bringewatt et al.
2011/0296626 A1 * 12/2011 Poy ..... D06F 31/00 8/137
2013/0061403 A1 * 3/2013 Bringewatt ..... B08B 13/00 8/137
2013/0291314 A1 * 11/2013 Poy ..... D06F 31/005 8/137
2014/0216111 A1 8/2014 Bringewatt et al.

FOREIGN PATENT DOCUMENTS

FR 2854173 A1 10/2004
JP 04-102990 9/1992
JP 07-000674 A 1/1995
JP 09-253383 9/1997
JP 2001-038372 2/2001
JP 2001-137590 5/2001
JP 2003-033597 4/2003
JP 2004-538112 A 12/2004
JP 2006-141786 6/2006
JP 2007-159660 6/2007
WO 03016608 A1 2/2003
WO WO-03016608 A1 * 2/2003 ..... D06F 31/005
WO WO-2009129362 A2 * 10/2009 ..... D06F 31/005

* cited by examiner

Transfer Rate Calculation for PF (Cell B7)

| | # Mods | # Wash | Conv WT | Xfer Rate | Wash Time | Output Kg/Hr |
|---|---|---|---|---|---|---|
| Conventional | 12 | 9 | 18 | 1.5 | 13.5 | 2720 |
| Conventional | 10 | 7 | 18 | 1.8 | 12.6 | 2267 |
| Conventional | 8 | 5 | 18 | 2.25 | 11.25 | 1813 |

Energy Consumption

| | Zone 1 | Zone 2 |
|---|---|---|
| GPM | 142 | 142 |
| GPH | 8524.966 | 8524.966 |
| Lb H20PH | 71098.22 | 71098.22 |
| Temp Rise | 50 | 30 |
| BTU/Hr | 3554911 | 2132946 |
| BTU/Lb | 763.8034 | 458.282 |

Extraction Calculation (Fill in Grey)

| P/C | Cotton | |
|---|---|---|
| 102 | 170 | Kg of Absored Water |
| 68 | 68 | Kg of Linen |
| 170 | 238 | |
| 0.35 | 0.55 | %MR |
| 23.8 | 37.4 | Kg Water in Linen |
| 78.2 | 132.6 | Kg Water Extracted |
| 1.15 | 1.95 | L/KG Extracted |

CONTINUOUS BATCH TUNNEL WASHER AND METHOD

CROSS-REFERENCE TO RELATED APPLICATIONS

This is a divisional application of U.S. patent application Ser. No. 12/765,500, filed 22 Apr. 2010, which is a nonprovisional patent application of U.S. Provisional Patent Application Ser. No. 61/171,682, filed 22 Apr. 2009; and 61/298,818, filed 27 Jan. 2010, each of which is hereby incorporated herein by reference.

Priority of U.S. Provisional Patent Application Ser. No. 61/171,682, filed 22 Apr. 2009, incorporated herein by reference, is hereby claimed. Priority of U.S. Provisional Patent Application Ser. No. 61/298,818, filed 27 Jan. 2010, incorporated herein by reference, is hereby claimed.

International Patent Application No. PCT/US2010/032039, filed 22 Apr. 2010, is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to continuous batch washers or tunnel washers. More particularly, the present invention relates to an improved method of washing textiles or fabric articles (e.g., on clothing, linen, etc.) in a continuous batch multiple module tunnel washer wherein the textiles are moved sequentially from one module or zone to the next module or zone. These zones can include dual use zones, because the zones are used for both washing and rinsing. Alternatively, all of the modules could be part of multi-use zones (i.e., pre-wash, main wash, and rinse). After a final module, fabric articles are then transferred to a liquid extraction device (e.g., press or centrifuge) that removes excess water. In one embodiment, the dual use zone can function: 1) as a standing bath for washing the fabric articles and 2) as a rinse zone utilizing a counterflow water rinse. In one embodiment a final zone is a finishing zone, where finishing chemicals are transmitted to the fabric articles. In another embodiment, sour solution is transferred to the fabric articles (e.g., sprayed) while those fabric articles are in the extraction device. By using a multi-use zone or a dual use zone, the present invention eliminates a need for a separate wash module(s) and rinse module(s).

2. General Background of the Invention

Currently, washing in a commercial environment is conducted with a continuous batch tunnel washer. Such continuous batch tunnel washers are known (e.g., U.S. Pat. No. 5,454,237) and are commercially available (www.milnor.com). Continuous batch washers have multiple sectors, zones, stages, or modules including pre-wash, wash, rinse and finishing zone.

Commercial continuous batch washing machines in some cases utilize a constant counter flow of liquor. Such machines are followed by a centrifugal extractor or mechanical press for removing most of the liquor from the goods before the goods are dried. Some machines carry the liquid with the goods throughout the particular zone or zones.

When a counter flow is used, there is counter flow during the entire time that the fabric articles or textiles are in the main wash module zone. This practice dilutes the washing chemical and reduces its effectiveness.

A final rinse with a continuous batch washer has been performed using a centrifugal extractor or mechanical press. In prior art systems, if a centrifugal extractor is used, it is typically necessary to rotate the extractor at a first low speed that is designed to remove soil laden water before a final extract.

Patents have issued that are directed to batch washers or tunnel washers. The following table provides examples, each listed patent hereby incorporated herein by reference.

TABLE

| U.S. PAT. NO. | TITLE | ISSUE DATE |
|---|---|---|
| 4,236,393 | Continuous tunnel batch washer | Dec. 2, 1980 |
| 4,363,090 | Process control method and apparatus | Dec. 7, 1982 |
| 4,485,509 | Continuous batch type washing machine and method for operating same | Dec. 4, 1984 |
| 4,522,046 | Continuous batch laundry system | Jun. 11, 1985 |
| 5,211,039 | Continuous batch type washing machine | May 18, 1993 |
| 5,454,237 | Continuous batch type washing machine | Oct. 3, 1995 |

BRIEF SUMMARY OF THE INVENTION

The present invention provides an improved method of washing fabric articles in a continuous batch tunnel washer. The method includes the providing of a continuous batch tunnel washer having an interior, an intake, a discharge, and a plurality of modules that divide the interior into zones, including dual use zones or a multi-use zone.

Dual use or multi-use zones enable use of each of the modules for multiple functions: pre-wash, main wash, rinse, finishing. As part of the method, the fabric articles are moved from the intake to the discharge and through the modules in sequence. These modules include dual use modules that each function as both a wash module and a rinse module. The method of the present invention provides a counter flow of liquid in the washer interior during rinsing, including some interrupted counter flow. The counter flow is along a path that is generally opposite the direction of travel of the fabric articles.

At a final module, the fabric articles are transferred via the discharge to a water extraction device. The extractor is used to remove excess water from the fabric articles after they have been discharged from the continuous batch tunnel washer. As part of the method, a sour solution can be flowed through the fabric articles during the extracting of excess water.

The present invention thus provides a continuous batch washer tunnel washer apparatus that achieves very low water consumption and greater throughput. For example, typical water consumption is between about 0.3-0.36 gallons per pound (2.4-3.0 liters per kilogram) for light to medium soil and between about 0.42 and 0.6 gallons per pound (3.5-5.0 liters per kilogram) for heavy soil.

The present invention employs dual use modules for highly efficient soil and release and removal. With the present invention, there are no dedicated wash or rinse modules, other than the last module which can be dedicated to finishing chemicals. The modules other than the last module are thus dual use. Typically, the first 50-75 percent of the transfer rate (time between transfers) is a standing bath for wash. The last 25-50 percent is high velocity counterflow rinsing. For example, the flow to maintain high velocity can be between about 50 and 150 gallons per minute (g.p.m.) (189 and 568 liters per minute).

In a standing bath module, chemical equilibrium is achieved in less than one minute, preferably in less than 30-40 seconds (for example, between about one and three reversals). A reversal is a complete rotation of the drum.

At chemical equilibrium, the soil-release effects of chemical energy (alkali pressure) and mechanical action in this bath are essentially complete. The suspended soil is now efficiently removed (rinsed away) by high velocity counterflow.

The present invention provides fully controlled (metered) water. All water inlets are metered to achieve precise injection volume for the given function: wet-out in module 11, fresh water makeup, and high velocity rinsing. All water inlets, except for fresh water makeup, are preferably pumped. This arrangement eliminates any inconsistencies in water flow, which can frequently occur as a consequence of fluctuations in incoming water pressure. For example, pumped water for flow is maintained at a pressure of between about 25-30 p.s.i. (1.7-2.1 bars) and at a flow rate of between 75 and 150 gallons per minute (g.p.m.) (284 and 568 liters per minute). Although fresh water is always subject to water pressure fluctuations, the present invention minimizes such fluctuations by providing a stabilization tank.

The present invention provides high velocity counterflow. The high velocity counterflow is comprised of extracted water and fresh water. The flow rate of the high velocity counterflow water inlets is based typically on about 30 seconds of flow and the following soil classification specific ratio:

light soil—0.30-0.42 gallons per pound (2.5-3.5 liters per kilogram) of linen medium soil—0.42-0.54 gallons per pound (3.5-4.5 liters per kilogram) of linen heavy soil—0.54-0.66 gallons per pound (4.5-5.5 liters) per kilogram) of linen A valve operation sequence at the beginning of counterflow increases counterflow velocity and thus rinsing efficiency. With the high velocity counterflow, a water injection valve opens first. Seconds later (for example, 5 seconds) the flow stop valve opens. This immediately increases the hydraulic head that powers the counterflow rinse.

The resulting flow rate provides maximum rinsing within the weir capacity, which is generally about 100 gallons per minute (379 liters per minute) for 150 pound (68 kilograms) capacity tunnel washers and 150 gallons per minute (568 liters per minute) for 250 pound (115 kilogram) capacity tunnel machines.

Each zone can have a maximum length of about 8 modules. This arrangement assures the affectiveness of the high velocity counterflow. High velocity counterflow zones can be sized and combined in the configuration required to meet any special temperature or disinfect time requirements.

The present invention provides high rinsing efficiency as a result of the rapid removal of suspended soil by high velocity counterflow and "top transfer effect," namely, the draining action that leaves behind about half of the free water when the perforated scoop lifts the goods out of one bath and moves them to the next cleaner bath. This arrangement is equivalent to a drain and fill in a washer-extractor. These two effects (high velocity counterflow rinsing and top transfer effect) and their combined effect are seen in FIG. 2 of the drawings. Chemical intensity is increased by virtual of the standing bath washing. Once chemical equilibrium is achieved, the top transfer effect, combined with the higher velocity counterflow rinsing effect, provides the highest dilution factor to rinse the suspended soil.

The present invention enables the use of fewer modules. The present invention provides comparable performance for an eight module continuous batch washer or tunnel washer when compared to a ten module conventional tunnel washer.

In one embodiment, a recirculation pump flows water in a recirculation loop from the bottom of a first module's shell into the linen loading chute. By using the module's own water instead of fresh water, this device reduces the overall water consumption by approximately 1 L/Kg. The recirculation pump flows at a rate of between 60 and 100 gallons per minute (g.p.m.) (227 and 379 liters per minute) to provide a forceful stream of water. This forceful stream of water wets the entire load of linen in one cylinder reversal of approximately ten (10) seconds where prior art needed the entire transfer rate time, normally between one and one half and three (1.5 to 3) minutes. Thus, most of the transfer rate time in the first module can now be used as a working module where prior art tunnel washers or continuous batch washers used the first module only to wet the linen. Thus, the production rate of the continuous batch washer or CBW is increased between five and twenty (5 and 20) percent.

The present invention includes a method of washing fabric articles in a continuous batch tunnel washer, comprising the steps of (a) providing a continuous batch tunnel washer having an interior, an intake, a discharge, a plurality of modules, and a volume of liquid; (b) moving the fabric articles from the intake to the modules in sequence; (c) wherein in step "b" multiple of the modules define a dual use zone; (d) adding a washing chemical to the volume of liquid in the dual use zone; (e) not counter flowing a rinsing liquid in the washer interior for a selected time interval after step "d"; (f) counter flowing a rinsing liquid in the washer interior along a flow path that is generally opposite the direction of travel of the fabric articles in steps "b" and "c"; and (g) using a water extraction device to remove excess liquid after step "e".

In one embodiment, the present invention further comprises adding a sour solution into the extraction device in step "g".

In one embodiment, counter flow of step "f" is at a flow rate of between about 35 and 105 gallons per minute (133 and 397 liters per minute).

In one embodiment, the extractor has a rotary drum with a side wall and an end wall, and wherein the spray is directed into the drum.

In one embodiment, the solution of step "g" includes a finishing solution.

In one embodiment, the present invention further comprises the step of heating liquid in the dual use zone before step "d".

In one embodiment, the present invention further comprises not rinsing in the extractor in step "g".

In one embodiment, liquid flow in the dual use zone is substantially halted for a time period that is less than about five minutes.

In one embodiment, liquid flow in the dual use zone is substantially halted for a time period that is less than about three minutes.

In one embodiment, liquid flow in the dual use zone is substantially halted for a time period that is less than about two minutes.

In one embodiment, liquid flow in the dual use zone is substantially halted for a time period that is between about twenty and one hundred twenty (20-120) seconds.

In one embodiment, the volume of liquid is heated to a temperature of between about 100 and 190 degrees Fahrenheit (38 and 88 degrees Celsius).

In one embodiment, the counter flow in step "f" extends through multiple of the modules.

In one embodiment, the dual use zone includes multiple modules.

In one embodiment, the sour solution is sprayed.

The present invention includes a method of washing fabric articles, comprising the steps of (a) providing a reservoir of washing liquid; (b) providing a continuous batch washing machine having an interior for holding fabric articles and multiple modules, one module being an inlet module, one module being an outlet module, one or more modules being wash modules and one or more modules being rinse modules; (c) placing fabric articles to be washed in the inlet module; (d) sequentially transferring the fabric articles from one module to another module until the fabric articles travel from the inlet module to the outlet module; (e) pumping the washing liquid from the reservoir to the washing machine interior in step "d"; and (f) pulse flowing fluid to the fabric articles for a selected time interval in one or more of the rinse modules.

In one embodiment, one or more finishing chemicals are added to the outlet module.

In one embodiment, pulse flow is added to the fabric articles in multiple of the modules.

In one embodiment, one of the finishing chemicals is a sour solution.

In one embodiment, fluid is discharged below a water surface in step "f".

In one embodiment, the fluid is directed upwardly in step "f".

In one embodiment, fabric articles are being rinsed in one of the modules in step "f" and then transferred to the outlet module.

In one embodiment, pulse flow of step "f" is separated into multiple modules that are not wash modules.

In one embodiment, the time interval of step "f" is between about 0.5 and 1.5 minutes.

In one embodiment, the time interval of step "f" is between about one half and two minutes.

The present invention includes a washer extractor apparatus, comprising (a) a continuous batch washing machine having a reservoir for holding a washing liquid and fabric articles to be washed, the washing machine having multiple modules including an inlet module, an outlet module, one or more wash modules and one or more rinse modules; (b) wherein the ratio of pounds of washing liquid to pounds of fabric articles is about 4 to 1, plus absorbed water when water is added to the reservoir; (c) a pump that enables pulse flowing of fluid to the fabric articles in said washing machine at a volume of between about 0.5 to 2 gallons per pound (4 to 17 liters per kilogram) of fabric articles for a selected time interval; and (d) wherein said pump is capable of transmitting water to the washing machine at the rate of 0.35 to 0.6 gallons of water per pound (3 to 5 liters of water per pound) of fabric articles within a selected time interval.

In one embodiment, the present invention further comprises a flow line for adding chemicals to the reservoir.

In one embodiment, the pump generates a fluid flow rate into said washing machine of between about 50 and 150 gallons per minute (g.p.m.) (189 to 568 liters per minute).

In one embodiment, water consumption is between about 1 and 2 gallons per pound (8 and 17 liters per kilogram) of processed fabric articles.

In one embodiment, the present invention further comprises a recirculation flow line that transmits liquid from said inlet module to said hopper.

The present invention includes a method of washing fabric articles in a continuous batch tunnel washer, comprising the steps of (a) providing a continuous batch tunnel washer having an interior, an intake hopper, a discharge, a plurality of modules, and a volume of liquid; (b) moving the fabric articles from the intake hopper to the modules in sequence; (c) wherein in step "b" multiple of the modules define a dual use zone wherein fabric articles are washed with washing chemicals and thereafter rinsed in the same modules; (d) adding a washing chemical to the volume of liquid in the dual use zone; (e) wherein step "d" defines a standing bath wherein the washing chemical and volume of liquid are not further diluted; (f) after step "e", counter flowing a rinsing liquid in the washer interior along a flow path that is generally opposite the direction of travel of the fabric articles in steps "b" and "c".

In one embodiment, liquid flow in the dual use zone is substantially halted for a time period that is less than about five minutes.

In one embodiment, liquid flow in the dual use zone is halted for a time period that is less than about three minutes.

In one embodiment, liquid flow into the dual use zone is halted for a time period that is less than about two minutes.

In one embodiment, liquid flow into the dual use zone is halted for a time period that is less than about one minute.

In one embodiment, liquid flow into the dual use zone is halted for a time period that is less than about thirty seconds.

In one embodiment, liquid flow into the dual use zone is halted for a time period that is between about twenty and one hundred twenty (20-120) seconds.

In one embodiment, flow in the dual use zone from one module to another module is substantially halted for a time period that is less than about five minutes.

In one embodiment, liquid flow in the dual use zone from one module to another module is halted for a time period that is less than about three minutes.

In one embodiment, liquid flow in the dual use zone is halted for a time period that is less than about two minutes.

In one embodiment, liquid flow in the dual use zone from one module to another module is halted for a time period that is less than about one minute.

In one embodiment, liquid flow in the dual use zone from one module to another module is halted for a time period that is less than about two minutes.

In one embodiment, liquid flow in the dual use zone from one module to another module is halted for a time period that is between about twenty and one hundred twenty (20-120) seconds.

The present invention includes a method of washing fabric articles in a continuous batch tunnel washer, comprising the steps of (a) providing a continuous batch tunnel washer having an interior, an intake hopper, a discharge, a plurality of modules, and a volume of liquid, (b) moving the fabric articles from the intake hopper to the modules in sequence, (c) wherein in step "b" multiple of the modules define a dual use zone wherein fabric articles are washed with washing chemicals and thereafter rinsed, (d) adding a washing chemical to the volume of liquid in the dual use zone, (e) not counter flowing a rinsing liquid in the washer interior for a selected time interval after step "d", (f) counter flowing a rinsing liquid in the washer interior along a flow path that is generally opposite the direction of travel of the fabric articles in the steps "b" and "c", and (g) using a water extraction device to remove excess liquid after the step of not counter flowing.

The present invention includes a method of washing fabric articles, comprising the steps of (a) providing a reservoir of washing liquid, (b) providing a continuous batch washing machine having an interior for holding fabric articles and multiple modules, a hopper for enabling addition of fabric articles to the interior one module being an inlet module, one module being an outlet module, multiple of said modules being dual use modules that function as both wash modules and rinse modules, (c) placing fabric articles to be washed in the inlet module, (d) sequentially transferring the fabric articles from one module to another module until the fabric articles travel from the inlet module to the outlet module and through the dual use modules, (e) pumping the washing liquid from the reservoir to the washing machine interior in step "d", (f) pulse flowing fluid to the fabric articles for a selected time interval in one or more of the dual use modules that function as rinse modules, and (g) wherein liquid is recirculated from the inlet module to the hopper.

The present invention includes a washer extractor apparatus, comprising (a) a continuous batch washing machine having a reservoir for holding a washing liquid and fabric articles to be washed, the washing machine having multiple modules including an inlet module, a hopper that enables addition of fabric articles to the first module, an outlet module, and dual use modules that function as both wash modules and rinse modules, (b) wherein the ratio of pounds of washing liquid to pounds of fabric articles is about 4 to 1, plus absorbed water when water is added to the reservoir, (c) a pump that enables pulse flowing of fluid to the fabric articles in said washing machine at a volume of between about 0.5 to 2 gallons per pound (4 to 17 liters per kilogram) of fabric articles for a selected time interval, and (d) wherein said pump is capable of transmitting water to the washing machine at the rate of about 0.35 to 0.6 gallons of water per pound (3 to 5 liters of water per pound) of fabric articles within a selected time interval.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
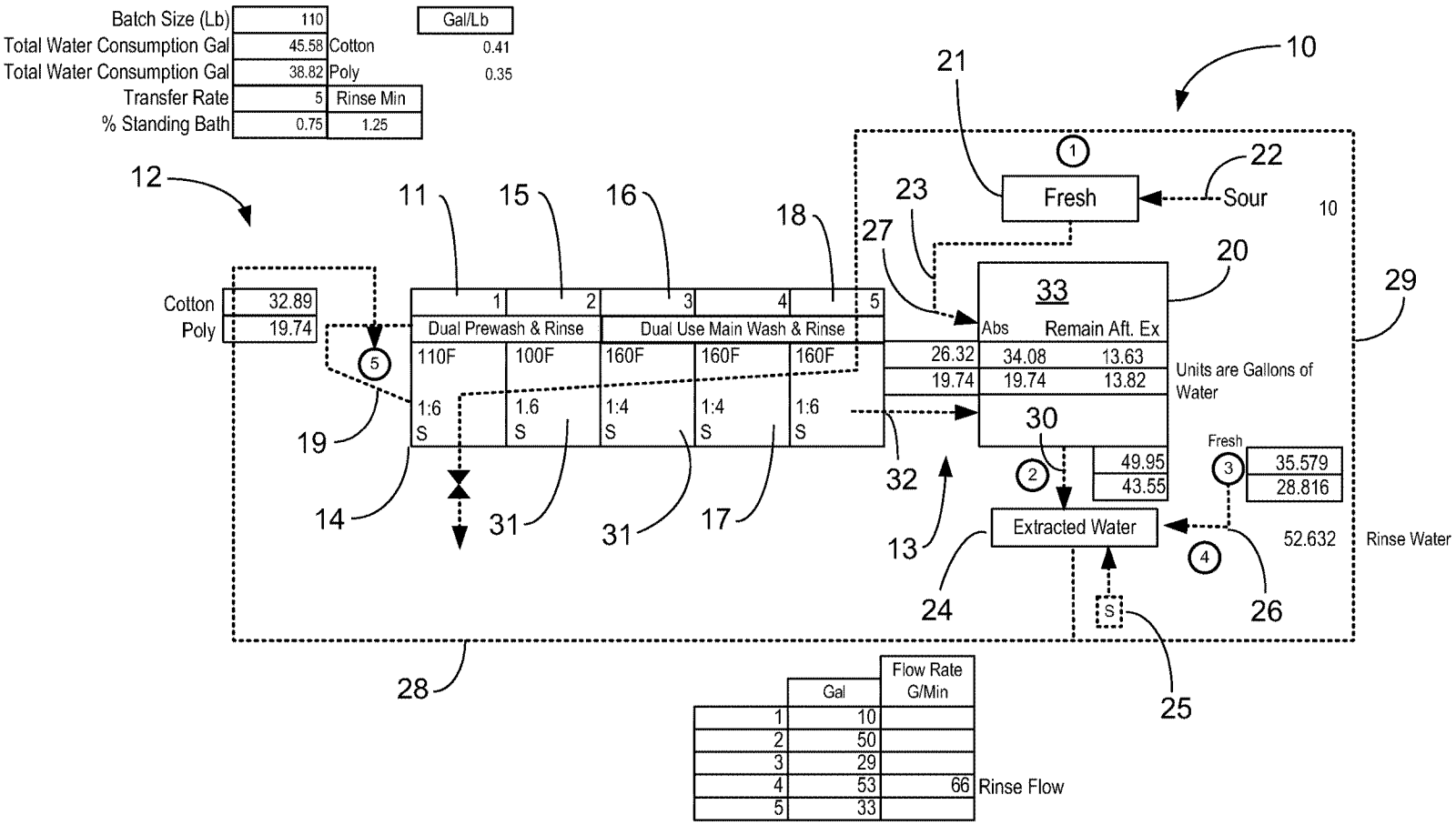
FIG. 1 is a schematic diagram showing a preferred embodiment of the apparatus of the present invention.

FIG. 1 shows a schematic diagram of the textile washing apparatus of the present invention, designated generally by the numeral 10. Textile washing apparatus provides a continuous batch washer or tunnel washer 11 having an inlet end portion 12 and an outlet end portion 13.

In FIG. 1, tunnel washer 11 provides a number of modules, sections or zones 14-18. These modules 14-18 can include a first module 14 and a second module 15 which can be pre-wash modules 14, 15. The plurality of modules 14-18 can also include modules 16, 17 and 18 which can be dual use modules in that the modules 16, 17, 18 function as both main wash and rinse modules. Modules 14-18 could all be dual use modules. For example, modules 14, 15 could function as pre-wash modules, modules 16, 17, 18 could function as main wash modules and all modules 14-18 could function as rinse modules. For "pre-wash" modules 14 and/or 15 a desired pre-wash chemical could be added to those modules. A main wash chemical could be added to modules 16, 17, 18.

The total number of modules 14-18 can be more or less than the five (5) modules shown in FIG. 1. Instead of a two (2) or three (3) module pre-wash section, a single module 14 could be provided as an alternate option for a pre-wash, module, section, or zone.

Inlet end portion 12 can provide a hopper 19 that enables the intake of textiles or fabric articles to be washed. Such fabric articles, textiles, goods to be washed can include clothing, linens, towels, and the like. An extractor 20 is positioned next to the outlet end portion 13 of tunnel washer 11. Flow lines are provided for adding water and/or chemicals (e.g., cleaning chemicals, detergent, etc.) to tunnel washer 11.

When the fabric articles, goods, linens are initially transferred into the modules 14, 15, 16, 17, 18, an interrupted counter flow for a part of the batch transfer time (i.e. the time that the fabric articles/linens remain in a module before transfer to the next successive module) is used. By using this interrupted counter flow for part (e.g., between about 50% and 90%, preferably about 75%) of the batch transfer time, each module 14, 15, 16, 17, 18 performs as a separate batch.

By halting counterflow when the modules 16, 17, 18 are functioning as main wash modules, this creates essentially a standing bath for the washing process and allows the cleaning chemicals to perform their function fully without any dilution from a counter flow. Counter flow returns for the last part (e.g., last 25%) of the transfer time and is pumped at a higher rate (e.g., between about three hundred (300) and four hundred (400) percent of the normal rate, or between about thirty-five (35) and one hundred five (105) gallons per minute (132 and 397 liters per minute), for example see FIG. 1).

Figure 2:
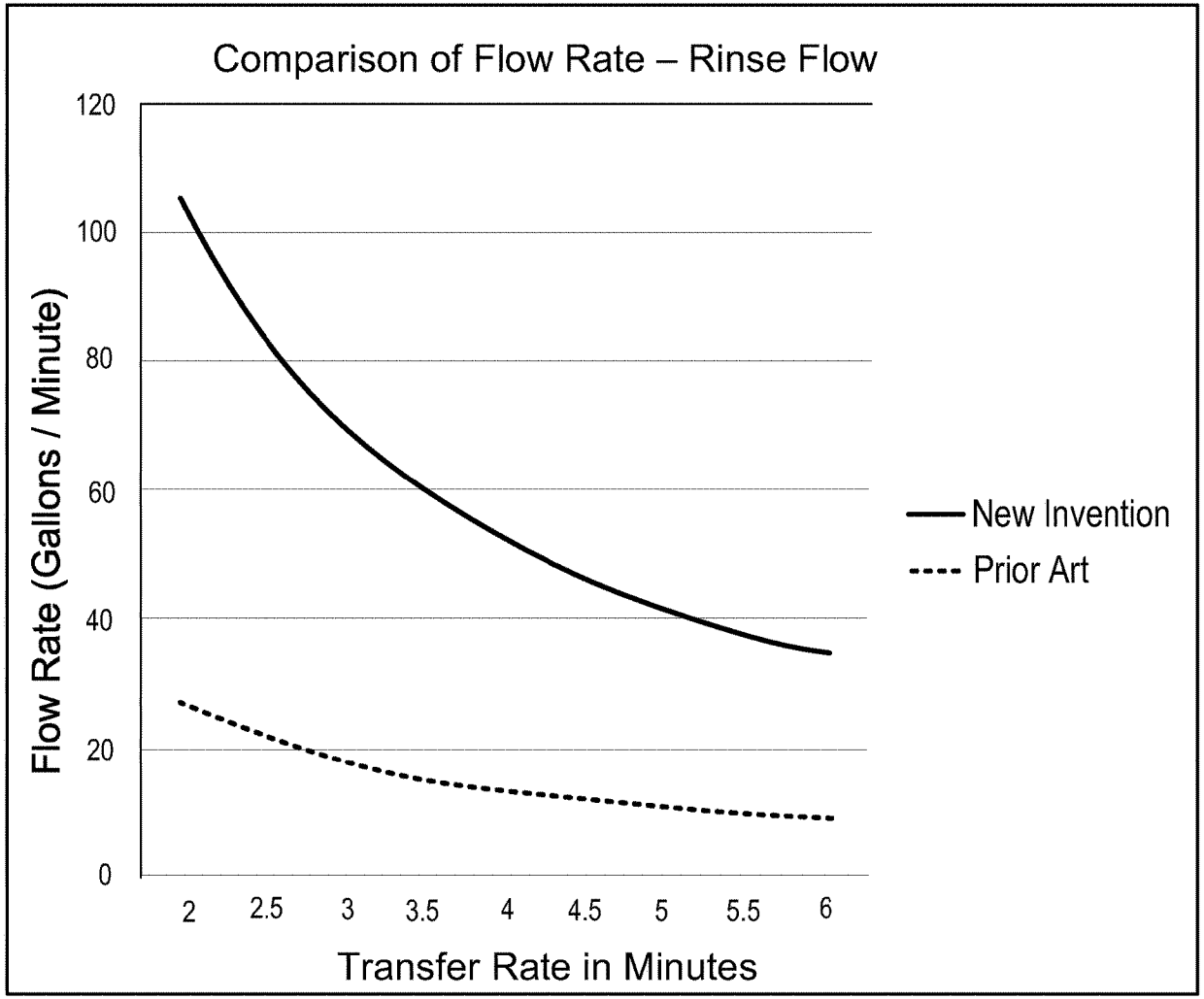
FIG. 2 is a graphical representation of a comparison of flow rate-rinse flow.

In FIG. 2, a flow rate of thirty five (35) gallons per minute (132 liters per minute) would require a transfer rate of six (6) minutes while a flow rate of one hundred five (105) gallons per minute (397 liters per minute) would require a transfer rate of about two (2) minutes. This higher rate is thus higher than the flow rate of prior art machines using full time counter flow. For example, prior art machines with full time counter flow typically employ a flow rate of between about ten and thirty (10-30) gallons per minute (38 and 114 liters per minute) (see FIG. 2) and creates a full rinsing hydraulic head. The present invention eliminates the need to have additional modules dedicated to the function of rinsing and finishing as required in the prior art, thus saving cost and floor space.

FIG. 1 shows the preferred embodiment of the apparatus of the present invention illustrated generally by the numeral 10. Textile washing apparatus 10 is shown in FIG. 1. FIG. 1 also illustrates the method of washing fabric articles in a continuous batch tunnel washer.

Textile washing apparatus 10 provides a tunnel washer 11. Tunnel washer 11 has an inlet end portion 12 and an outlet end portion 13. Tunnel washer 11 has an interior 31 that is divided into sections or modules. These modules can include modules 14, 15, 16, 17, 18, and can include additional modules.

Hopper 19 is positioned at inlet end portion 12. The hopper 19 enables the intake of fabric articles to be washed.

A water extracting device 20 (e.g., press or centrifuge) is positioned next to discharge 32. The extraction device 20 is used to remove excess water or extracted water from the fabric articles after they have been discharged from the tunnel washer 11 and placed within the extractor 20. Extraction devices 20 are commercially available, typically being a centrifuge or a press.

The modules 14-18 in FIG. 1 can be dual use modules and include one or more pre-wash modules such as 14, 15 and one or more main wash modules 16, 17, 18. All five modules (14-18) could function as rinse modules. When functioning as a main wash or standing bath, counterflow via line 29 can be slowed or halted for a time. Then, counterflow resumes during rinsing. Water flows via flow line 29 into each module. In FIG. 1, the flow line 29 enters at module 18 and then passes through modules 17, 16, 15, 14 in that order. Flow can be pumped flow into the bottom shell of the last module 18 in FIG. 1. From the last module 18 to the previous module 17, water can flow over a weir of module 18 to a pipe or flow line that is connected to module 17. Similarly, from module 17, water can flow over a weir of module 17 to a pipe or flow line that is connected to module 16. From module 16, water can flow over a weir of module 16 to a pipe or flow line that is connected to module 15. From module 15, water can flow over a weir of module 15 to a pipe or flow line that is connected to module 14. However, in FIG. 1, this flow of counter flowing water is schematically illustrated by flow line 29 as it traverses modules 18, 17, 16, 15, 14 in that sequence.

A water storage tank 21 can be a freshwater storage tank. A sour solution and/or finishing chemicals can be prepared by injecting tank 21 with a sour solution and/or finishing solution that is delivered via sour inflow line 22. Flow line 23 transmits the sour solution and/or finishing solution from tank 21 to the interior 33 of extraction device 20 as indicated by arrow 27. Finishing solutions can be any desired or known finishing solution, for example a starch solution or an antimold agent. An example of a starch solution is "Turbocrisp" manufactured by Ecolab, Inc., Textile Care Division of St. Paul, Minn. An example of an antimold agent is "Nomold" manufactured by Ecolab, Inc., Textile Care Division (www.ecolab.com).

An extracted water tank 24 can be positioned to receive extracted water from extraction device 20. Flow line 30 is a flow line that transfers water from extraction device 20 to tank 24. Water contained in tank 24 can be recycled via flow lines 28 or 29. A sour solution can be injected at 24 via sour inflow tank 25. Freshwater can be added to tank 24 via freshwater inflow 26. Flow line 28 is a recirculation line that transfers extracted water from tank 24 to hopper 19. Another recirculation flow line is flow line 29. The flow line 29 transfers extracted water from tank 24 to interior 31 of tunnel washer 11, beginning at final module 18 and then counterflow to modules 17, 16, 15, 14 in sequence.

For the continuous batch washing apparatus 10 of FIG. 1, five modules 14, 15, 16, 17, 18 are shown as an example. The temperatures of each of the modules 14-18 is shown as an example. The module 14 can thus have a temperature of around 110 degrees Fahrenheit (43 degrees Celsius). The module 15 can have a temperature of around 100 degrees Fahrenheit (38 degrees Celsius). In the example of FIG. 1, each of the modules 14, 15 can be part of a pre-wash. They could also be dual use modules. In such a case, they could be part of a rinse function. In FIG. 1, rinse liquid counterflows via flow line 29 to module 18, then to module 17, then to module 16, then to module 15, and then to module 14 where rinse water can be discharged via a discharge valve or discharge outlet.

The module 16 can have a temperature of around 160 degrees Fahrenheit (71 degrees Celsius). The module 17 can have a temperature of around 160 degrees Fahrenheit (71 degrees Celsius). The module 18 can also have a temperature of around 160 degrees Fahrenheit (71 degrees Celsius). The modules 14, 15, 16, 17, 18 can be dual use modules and thus can define a main wash and a rinse portion of tunnel washer 11.

In the example of FIG. 1, a batch size can be about 110 pounds (50 kilograms) of textiles. Total water consumption would be between about 0.4 and 0.62 gallons per pound (3.3 and 5.2 liters per kilogram) of cotton textile fabrics. Total water consumption would be between about 0.35 and 0.64 gallons per pound (2.9 and 5.3 liters per kilogram) of "poly" or polycotton (e.g. a blend of cotton and poly or polyester) articles. Polycotton is commonly used for making various fabric articles (e.g. bed sheets).

The modules 14-18 could have differing capacities. For example, the module 14 could be a ten (10) gallon (38 liter) module while the module 15 could be a forty (40) gallon (151 liter) module. The module 16 could be a sixty (60) gallon (227 liter) module. The module 17 could be a sixty-six (66) gallon (250 liter) module wherein the module 18 would have a capacity of about thirty-three (33) gallons (125 liters).

FIG. 1 shows examples of water volumes expressed in liter per kilogram of linen (or fabric articles). In FIG. 2, rinse flow (counter flow) rate is about one hundred five (105) gallons per minute (397 liters per minute) for about two minutes or about (35) gallons per minute (132 liters per minute) for about six (6) minutes. Other batch size could be e.g., between fifty (50) and three hundred (300) pounds (23 and kilograms) of fabric articles.

FIGS. 3-7 are flow diagrams that further illustrate the method and apparatus of the present invention. These FIGS. 3-7 illustrate that all finishing chemicals can be added in the last module of a continuous batch washer or CBW, designated generally by the numeral 46. A prior art continuous batch washer can be seen in U.S. Pat. Nos. 4,236,393; 4,363,090; 4,485,509; 4,522,046; 5,211,039; and 5,454,237; each of which is hereby incorporated herein by reference.

Figure 3:
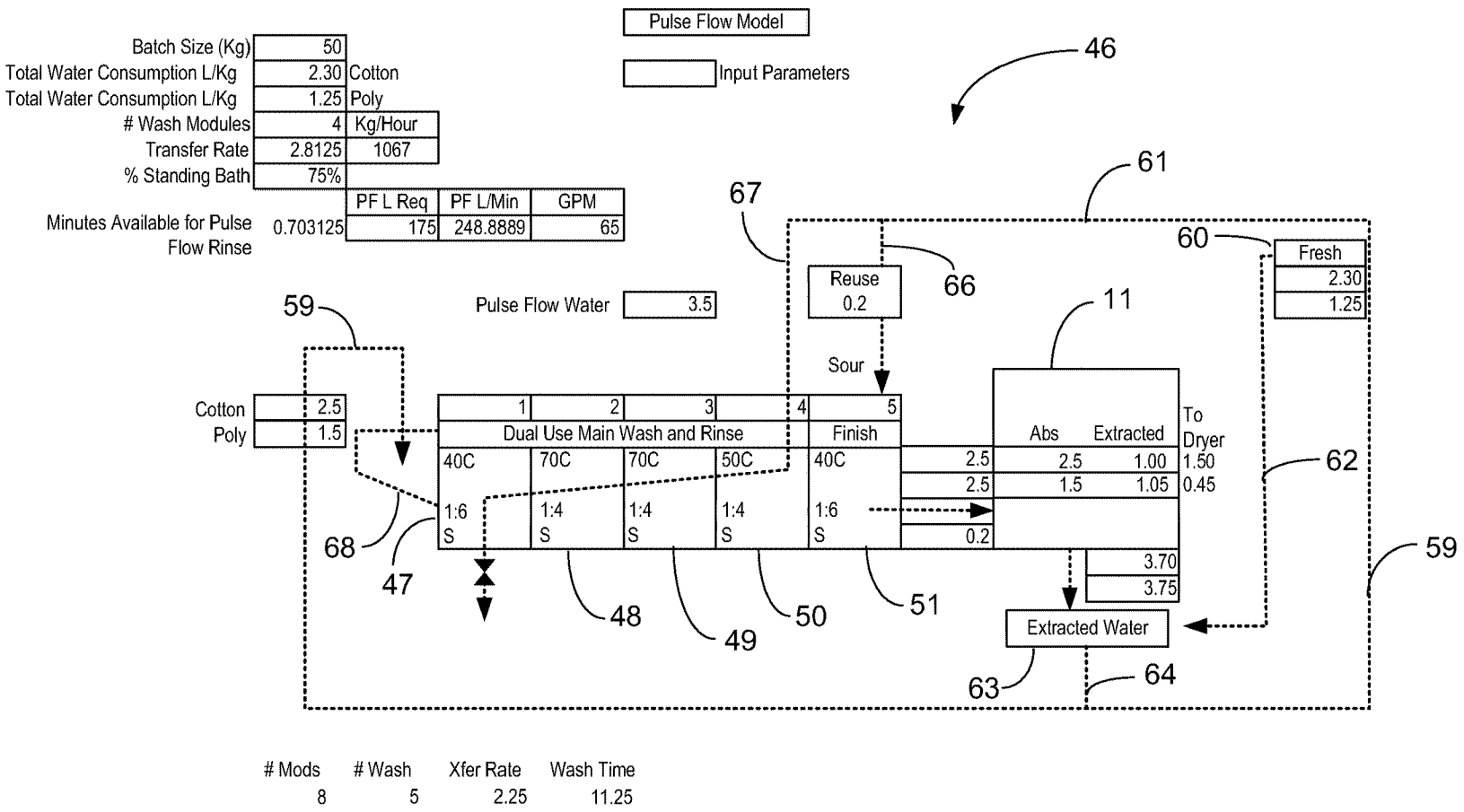
FIG. 3 is a schematic diagram that illustrates an embodiment of the method and apparatus of the present invention.
Figure 4:
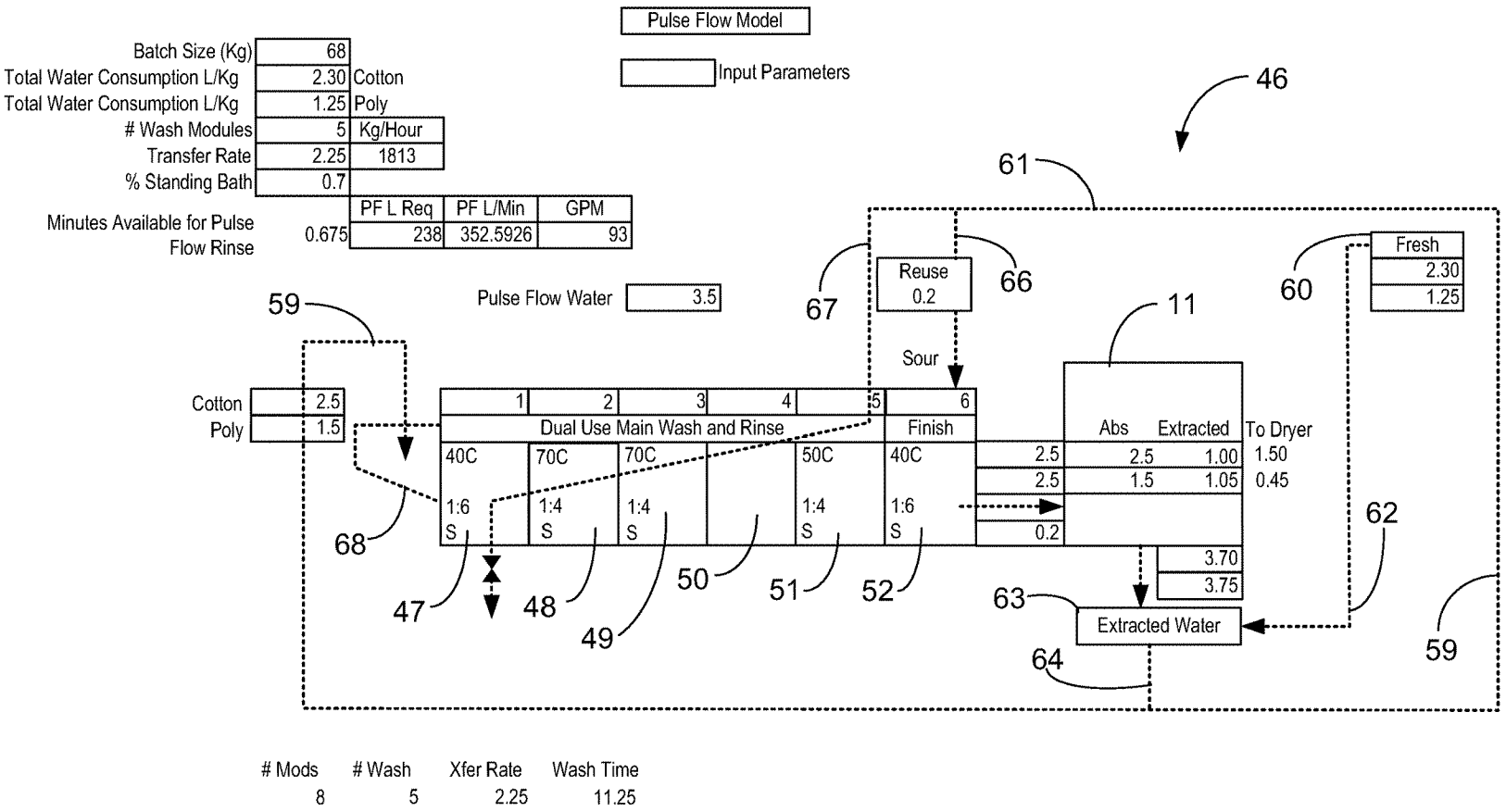
FIG. 4 is a schematic diagram that illustrates an embodiment of the method and apparatus of the present invention.
Figure 5:
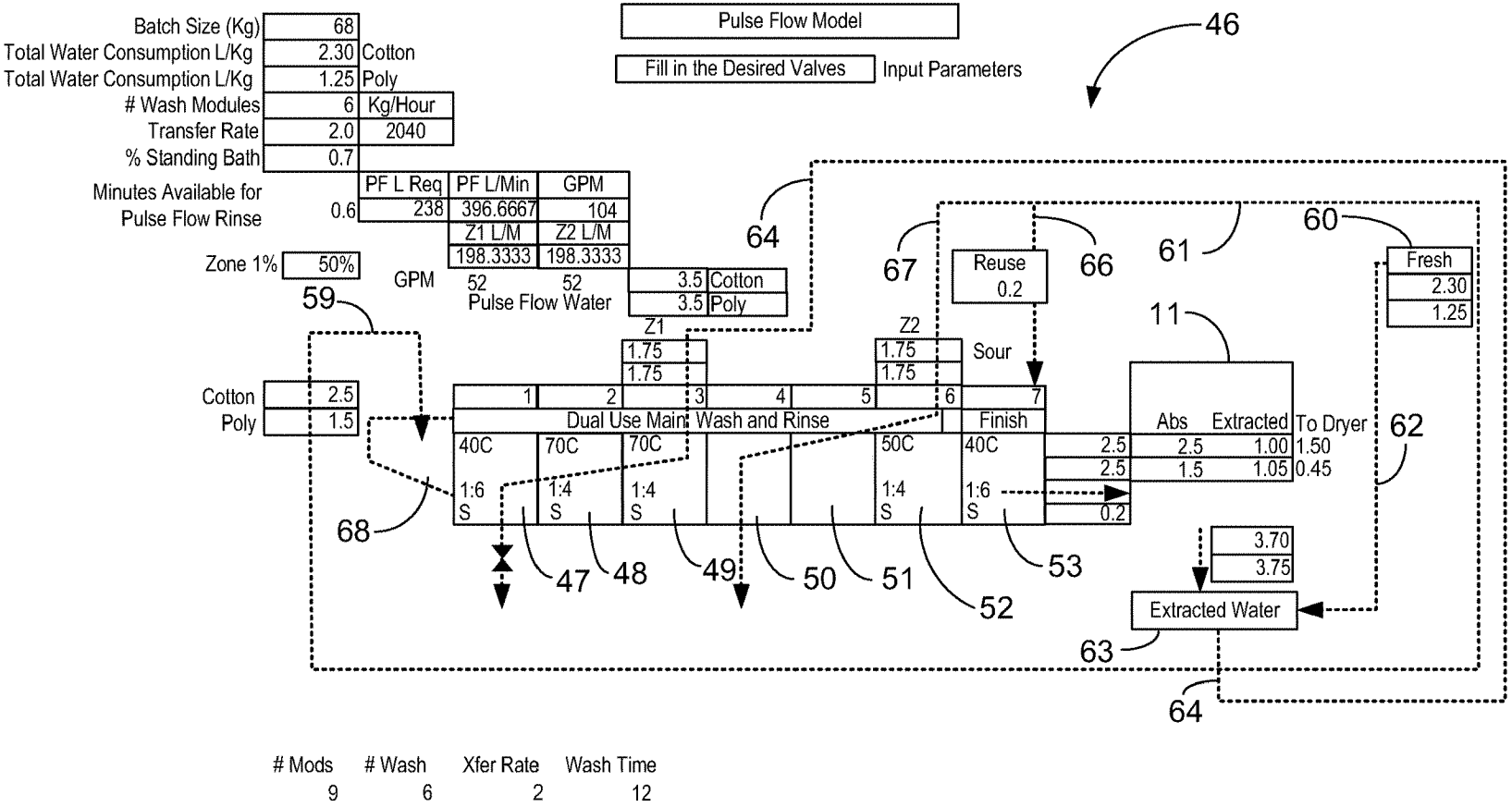
FIG. 5 is a schematic diagram that illustrates an embodiment of the method and apparatus of the present invention.
Figure 6:
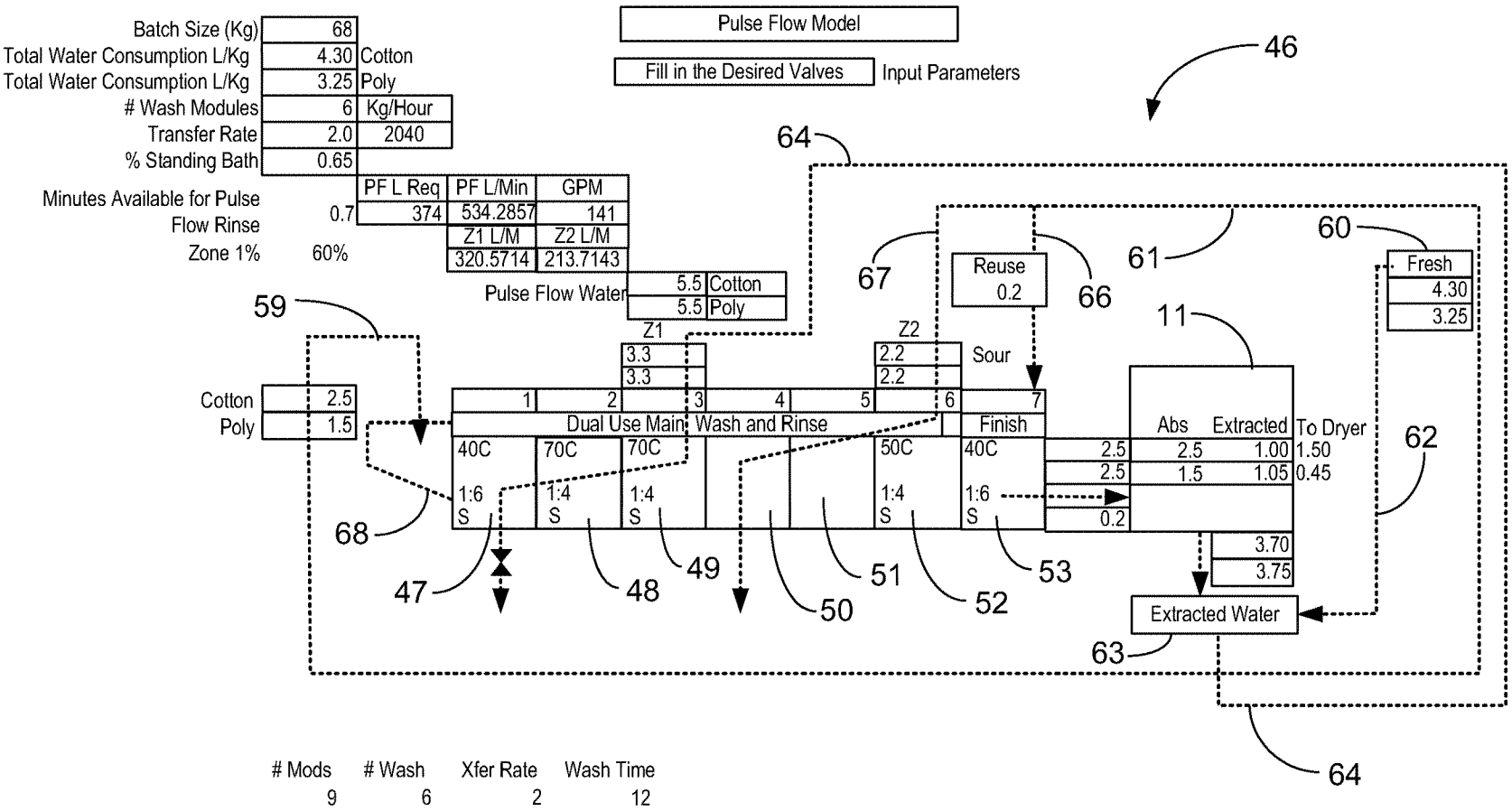
FIG. 6 is a schematic diagram that illustrates an embodiment of the method and apparatus of the present invention.
Figure 7:
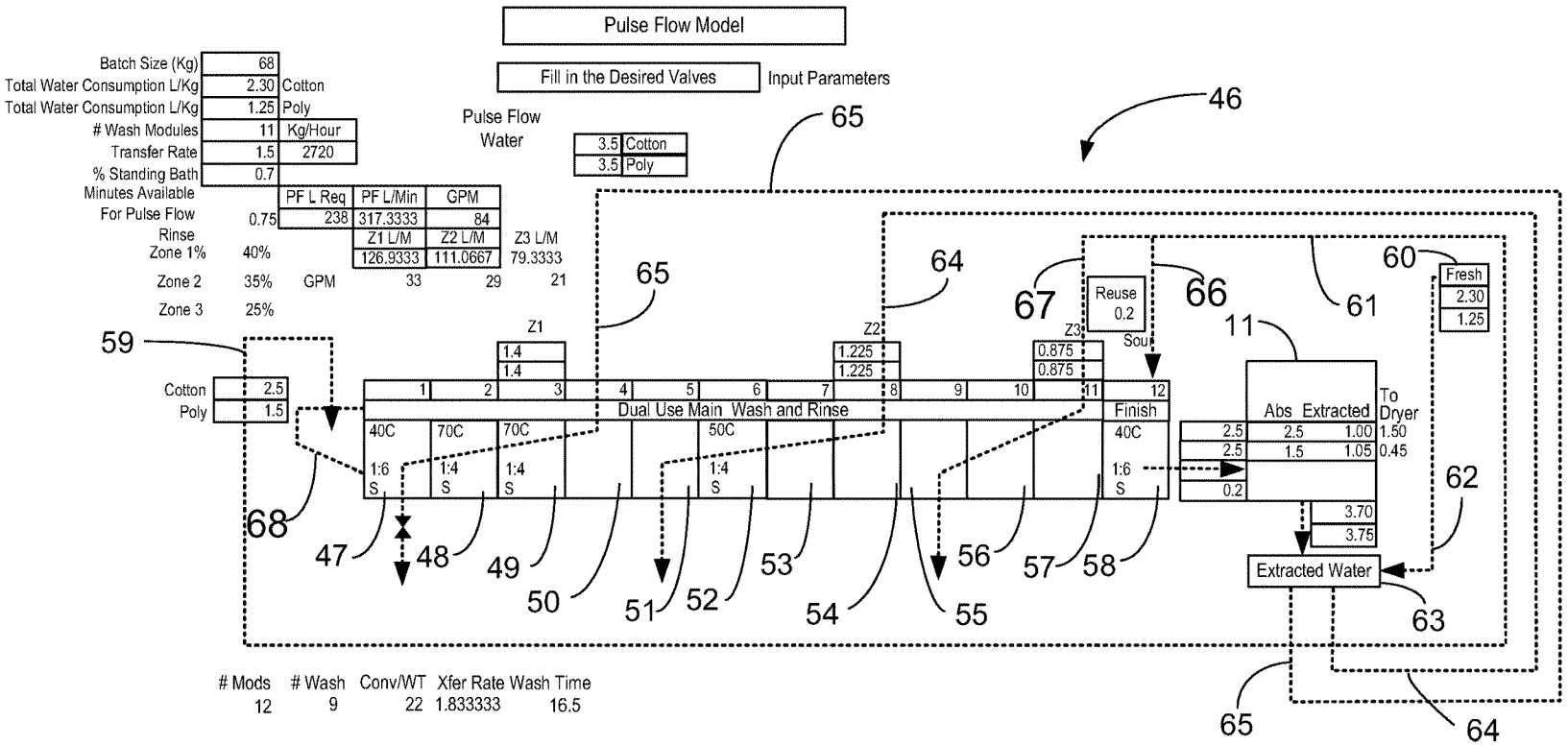
FIG. 7 is a schematic diagram that illustrates an embodiment of the method and apparatus of the present invention.

In FIG. 3, modules 47-51 are provided. In FIG. 4, modules 47-52 are provided. In FIGS. 5-6, there are modules 47-53. In FIG. 7 there are modules 47-58.

For each of the washers 46, there is a hopper 68 for enabling fabric articles, clothing, linens, etc. to be added to the washer. There are flow lines shown in the FIGS. 3-7 which demonstrate the flow of water from a fresh water source 60 or from extracted water tank 63. Flow line 59 is an inlet or influent flow line for each example of FIGS. 3-7, transmitting clean or fresh water from source 60 to hopper 68.

In FIGS. 3-7, flow line 64 shows that extracted water can be added from tank to flow line 59. Flow line 62 is a water or fresh water flow line receiving water from source 60. Flow line 61 branches into flow lines 66, 67. Flow line 67 counter flows water to modules 50, 49, 48 and then 47 which are wash and rinse modules in FIG. 3. Flow line 66 transmits water to module 51 which is a finishing module. In FIG. 4, flow line 67 counter flows water to modules 51, 50, 49, 48 and then 47 which are wash and rinse modules in FIG. 4. Flow line 66 transmits water to module 52 which is a finishing module in FIG. 4.

In FIGS. 5-6, flow line 64 transmits water from extracted water tank 63 to modules 49, 48 and then 47 in counter flow fashion. Flow line 62 is a fresh water flow line receiving water from source 60. Flow line 61 branches into flow lines 66, 67. Flow line 67 counter flows water to modules 52, 51, and then 50. Flow line 66 transmits water to module 53 which is a finishing module in FIGS. 5-6.

In FIG. 7, flow line 65 counter flows water from extracted water tank 63 to modules 50, 49, 48, and then 47. Flow line 64 counter flows water from extracted water tank 63 to modules 54, 53, 52, and then 51. Fresh water flow line 61 transfers water from source 63 to flow lines 66, 67. Flow line 67 counter flows water to modules 57, 56, and then 55. Flow line 66 transmits water to module 58 which is a finishing module in FIG. 7.

FIGS. 3-7 are examples of flow diagrams when using the method and apparatus of the present invention. For each example, various parameters are given, including batch size in kilograms (Kg), total water consumption (for cotton and for poly) in liters per kilogram (L/Kg), transfer rate and % standing bath. Minutes available for pulse flow rinse are given as are pulse flow liters required and pulse flow liters per minute. Gallons per minute are displayed for each example.

These FIGS. 3-7 illustrate that all finishing chemicals can be added to the continuous batch washer 46 (e.g., last module) and not in the centrifuge or extractor (e.g., machine 11). In the longer continuous batch washers (e.g., FIGS. 3, 4, 5, 6 and 7), the pulse flow can separated into multiple zones. This is preferable because the hydraulic head pressure of more than four (4) modules cannot be easily overcome in the short time that the process allows for the pulse flow (e.g., between about 30 and 120 seconds).

The rinsing efficiency of the method and apparatus of the present invention is the result of two effects which can be called the "pulse flow effect" and the "top transfer effect." The "pulse flow effect" is the rapid removal of suspended soil by high velocity and high flow rate (e.g. about 100 gallons per minute or g.p.m. (379 liters per minute)) counterflow. The "top transfer effect" is the draining action that leaves behind part (about half) of the free water when the perforated transfer scoop of the tunnel washer lifts the goods (textile articles) out of one bath and moves them to the next cleaner bath. This arrangement is equivalent to a drain and fill in a washer-extractor.

Figure 8:
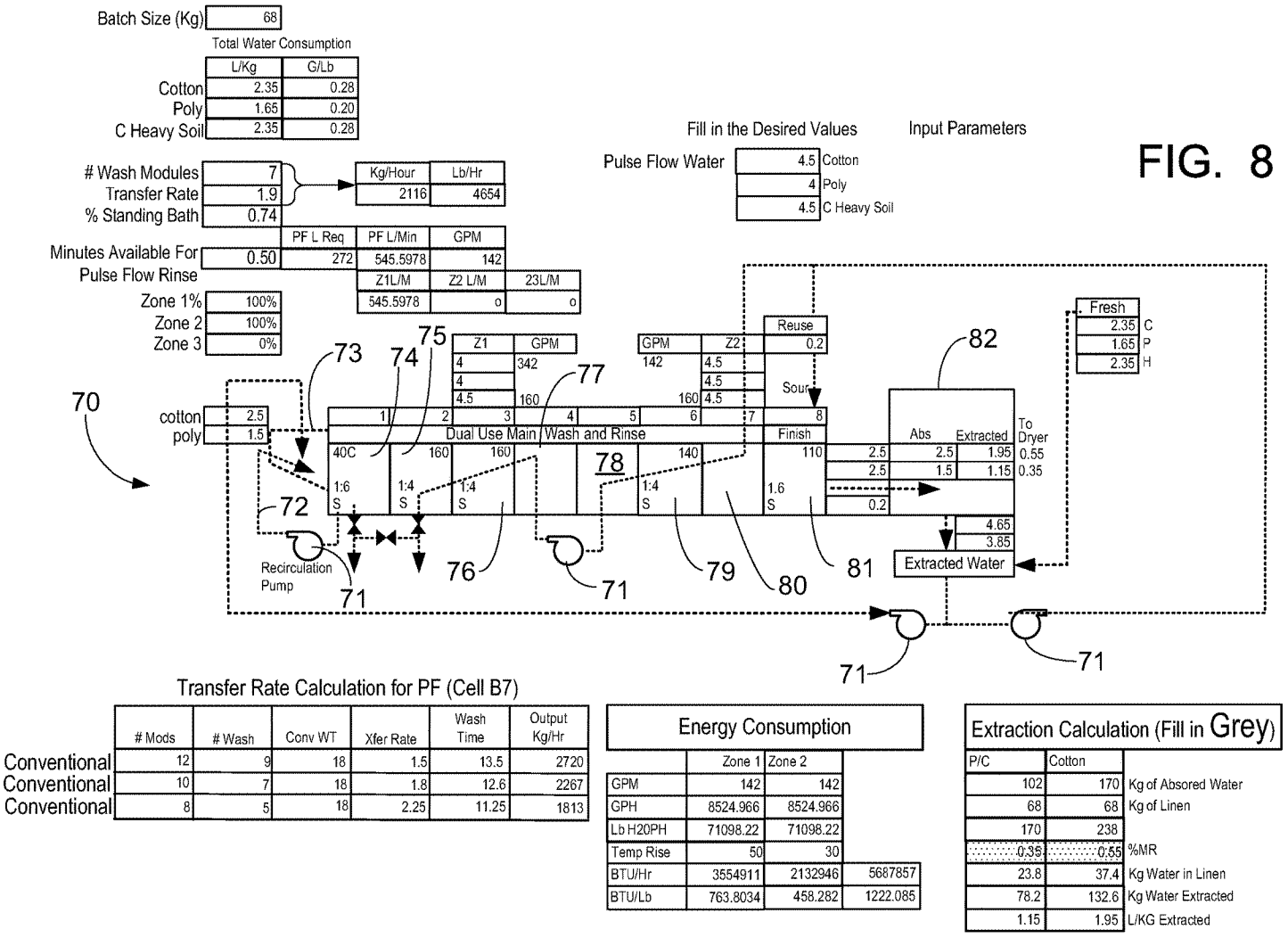
FIG. 8 is a schematic diagram that illustrates yet another embodiment of the method and apparatus of the present invention.

FIG. 8 shows another embodiment of the apparatus of the present invention, designated generally by the numeral 70. In FIG. 8, textile washing apparatus 70 can have modules 74-81, recirculation pumps 71 and extractor 82. Washing apparatus 70 employs a recirculation pump 71 that flows water in a recirculation loop flow line 72 from the bottom of the first module shell into the linen loading chute 73. By using the module's (74) own water instead of fresh water, this apparatus 70 reduces the overall water consumption (e.g. by approximately 1 L/Kg). The recirculation pump 71 can flow at a rate of between about sixty and one hundred (60-100) gallons per minute (g.p.m.) (227-379 liters per minute) to provide a forceful stream of water. This forceful stream of water wets the entire load of linen in one cylinder reversal of approximately ten (10) seconds where prior art tunnel washers typically require the entire transfer rate time, normally between one and one half and three (1.5-3) minutes for a prior art tunnel washing machine. Thus, most of the transfer rate time in the first module can now be used as a working module where in prior art tunnel washers, the first module is only used to wet the linen. The production rate of the continuous batch washer 70 (or CBW) of FIG. 8 is increased between about five and twenty (5 and 20) percent.

Formula times in a tunnel washer of the present invention are shorter than in a conventional tunnel. The dual use modules in a the tunnel washer of the present invention perform the same functions as that of both the wash modules and the rinse modules in a conventional tunnel. By the time that goods enter the finish module, they have undergone equal or better processing in the tunnel washer of the present invention than that of a conventional tunnel with the same number of wash modules as dual use modules in the tunnel washer machine of the present invention.

Conventional top transfer tunnels of six modules or less have one rinse module. Those with seven modules or more have two rinse modules. Hence, the ratio of rinse to wash modules changes with different size conventional tunnels. The ratio of rinse to wash functions in a PulseFlow tunnel is not influenced by tunnel size. Hence, it is possible to state, as a percentage, the difference in formula length for a conventional, top transfer tunnel, as recommended by the Textile Rental Services Association, and a PulseFlow tunnel, regardless of tunnel length. Based on current field data, this is 81%.

Table 1 below provides a list of processing times for conventional, top transfer tunnels and corresponding times for tunnels of the present invention, along with the transfer rates for a range of tunnel sizes.

TABLE 1

Transfer Ratesfor Conventional CBW Tunnel Washers

| | Processing Time | | Transfer Rates | | | | | | | |
|---|---|---|---|---|---|---|---|---|---|---|
| | | | 5 | 6 | 7 | 8 | 9 | 10 | 11 | 12 |
| Goods Classification | Conventional * | PulseFlow | Mod | Mod | Mod | Mod | Mod | Mod | Mod | Mod |
| Vinyl floor mats | 14 minutes | 11.3 minutes | 2.26 | 1.88 | 1.61 | 1.41 | 1.26 | 1.13 | 1.03 | 0.94 |
| Hotel sheets | 16 minutes | 13 minutes | 2.6 | 2.17 | 1.86 | 1.63 | 1.44 | 1.3 | 1.18 | 1.08 |
| Hotel/hospital room linen | 18 minutes | 14.6 minutes | 1.92 | 2.4 | 2.09 | 1.83 | 1.62 | 1.46 | 1.33 | 1.22 |

TABLE 1-continued

Transfer Ratesfor Conventional CBW Tunnel Washers

| | Processing Time | | Transfer Rates | | | | | | | |
|---|---|---|---|---|---|---|---|---|---|---|
| | | | 5 | 6 | 7 | 8 | 9 | 10 | 11 | 12 |
| Goods Classification | Conventional * | PulseFlow | Mod | Mod | Mod | Mod | Mod | Mod | Mod | Mod |
| General hospital linen | 21 minutes | 17 minutes | 3.4 | 2.8 | 2.43 | 2.13 | 1.89 | 1.7 | 1.55 | 1.42 |
| Adult pads/diapers | 24 minutes | 19.4 minutes | 3.88 | 3.23 | 2.77 | 2.43 | 2.16 | 1.94 | 1.76 | 1.62 |
| Colored table linen | 24 minutes | 19.4 minutes | 3.88 | 3.23 | 2.77 | 2.43 | 2.16 | 1.94 | 1.76 | 1.62 |
| Industrial uniforms | 28 minutes | 22.7 minutes | 4.54 | 3.78 | 3.24 | 2.84 | 2.52 | 2.27 | 2.06 | 1.89 |
| White table linens | 30 minutes | 24.3 minutes | 4.86 | 4.05 | 3.47 | 3.04 | 2.7 | 2.43 | 2.21 | 2.03 |
| Bar mops | 34 minutes | 27.5 minutes | 5.5 | 4.58 | 3.93 | 3.44 | 3.06 | 2.75 | 2.5 | 2.29 |
| Industrial wipers | 36 minutes | 29.2 minutes | 5.84 | 4.87 | 4.17 | 3.65 | 3.24 | 2.92 | 2.65 | 2.43 |

* Source: Textile Laundering Technology 2005 ed. Alexandria, VA: Textile Rental services Association of America 2005. Print.

For each of the following parameters, exemplary minimum and maximum ranges of values are provided:

Values for FIGS. 1 Through 7

The batch size (Lb) can be between about 90 and 150 pounds (41 and 68 kilograms).

The total water consumption in gallons for cotton can be between about 27 and 75 gallons (102 and 284 liters).

The total water consumption gallons for Poly can be between about 22.5 and 75 gallons (85 and 284 liters).

The transfer rate can be between about 2 and 6 minutes.

The percent (%) standing bath can be between about 50 and 75 percent.

The rinse time in minutes can be between about 0.5 and 3 minutes.

The total water consumption can be between about 0.3 and 0.5 gallons per pound (gal/lb) (3 and 4 liters per kilogram) for cotton.

The total water consumption can be between about 0.25 and 0.5 gallons per pound (gal/lb) (2 and 4 liters per kilogram) for poly.

The gallons of water entering hopper 19 (cotton and poly) can be between about 25 and 45 gallons (95 and 170 liters) for cotton and between about 15 and 28 gallons (57 and 106 liters) for poly.

The gallons of water during discharge from tunnel washer 11 (for cotton and poly) can be between about 50 and 65 gallons (189 and 246 liters) for both cotton and poly.

The gallons of water in interior of extraction device 20 before extraction (for cotton and poly) can be between about 50 and 70 gallons (189 and 265 liters) for cotton and between about 35 and 45 gallons (132 and 170 liters) for poly.

The gallons of water in interior of extraction device 20 after extraction (for cotton and poly) can be between about 9.9 and 16.5 gallons (37 and 62 liters) for cotton and between about 9 and 18 gallons (34 and 68 liters) for poly.

The gallons of water extracted from extraction device 20 to extracted water tank 24 (for cotton and poly) can be between about 40 and 55 gallons (151 and 208 liters) for cotton and between about 25 and 28 gallons (95 and 106 liters) for cotton.

The gallons of water from freshwater inflow 26 (cotton and poly) can be between about 27 and 75 gallons (95 and 284 liters) for cotton and between about 22 and 75 gallons (83 and 284 liters) for poly;

The gallons of rinse water can be between about 50 and 65 gallons (189 and 246 liters) for cotton or for poly.

The temperatures in FIG. 1 can be: for module 14 between about 100 and 130 degrees F. (38 and 54 degrees C.), for module 15 between about 130 and 180 degrees F. (54 and 82 degrees C.), for module 16 between about 150 and 180 degrees F. (66 and degrees C.), for module 17 between about 150 and 160 degrees F. (66 and 71 degrees C.), and for module 18 between about 100 and 130 degrees F. (38 and 54 degrees C.)

For FIGS. 1-8, exemplary temperatures are shown in the figures in each module such as the 40 degrees C. for module 51 in FIG. 3, 40 degrees C. for module in FIG. 4, 40 degrees C. for module 53 in FIGS. 5 and 6, and 40 degrees C. for module 58 in FIG. 7.

The following is a list of parts and materials suitable for use in the present invention.

PARTS LIST

| Part Number | Description |
|---|---|
| 10 | textile washing apparatus |
| 11 | tunnel washer |
| 12 | inlet end portion |
| 13 | outlet end portion |
| 14 | module |
| 15 | module |
| 16 | module |
| 17 | module |
| 18 | module |
| 19 | hopper |
| 20 | extraction device |
| 21 | freshwater tank |
| 22 | sour inflow line |
| 23 | flow line |
| 24 | extracted water tank |
| 25 | sour inflow |
| 26 | freshwater inflow |
| 27 | arrow |
| 28 | flow line |
| 29 | flow line |
| 30 | flow line |
| 31 | interior |
| 32 | discharge |
| 33 | interior |
| 46 | textile washing apparatus |
| 47 | module |
| 48 | module |
| 49 | module |
| 50 | module |
| 51 | module |
| 52 | module |
| 53 | module |
| 54 | module |
| 55 | module |
| 56 | module |
| 57 | module |
| 58 | module |
| 59 | flow line |
| 60 | water source |
| 61 | flow line |

-continued

| PARTS LIST | |
|---|---|
| Part Number | Description |
| 62 | flow line |
| 63 | tank |
| 64 | flow line |
| 65 | flow line |
| 66 | flow line |
| 67 | flow line |
| 68 | hopper |
| 70 | textile washing apparatus |
| 71 | recirculation pump |
| 72 | recirculation loop flow line |
| 73 | linen loading chute |
| 74 | module |
| 75 | module |
| 76 | module |
| 77 | module |
| 78 | module |
| 79 | module |
| 80 | module |
| 81 | module |
| 82 | extractor |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of washing fabric articles in a continuous batch tunnel washer, comprising the steps of:

a) providing a continuous batch tunnel washer having an interior, an intake, a discharge, a plurality of modules, and a volume of liquid;

b) moving the fabric articles from the intake to the discharge and through each of the modules in sequence;

c) wherein in step "b" multiple of the modules define a dual use zone wherein each of the modules of said dual use zone function as both wash modules and rinse modules;

d) adding a washing chemical to the volume of liquid in the dual use zone;

e) during a first period of a particular batch time the fabric articles are spending in a particular dual use module not counter flowing a rinsing liquid in the washer interior for a selected time interval after step "d";

f) after step "e" during a second period of time of the particular batch time the fabric articles are spending in the particular dual use module counter flowing a rinsing liquid in the washer interior along a flow path that is generally opposite the direction of travel of the fabric articles in steps "b" and "c" and in one or more of the dual use modules; and g) using a water extraction device to remove excess liquid after step "f".

2. The method of claim 1 wherein counter flow of step "f" is at a flow rate of between about 35 and 105 gallons per minute (133 and 397 liters per minute).

3. The method of claim 1 further comprising the step of heating liquid in said dual use zone before step "d".

4. The method of claim 1 further comprising not rinsing in the water extraction device in step "g".

5. The method of claim 1 wherein liquid flow in said dual use zone is substantially halted for a time period that is less than about five minutes.

6. The method of claim 1 wherein liquid flow in said dual use zone is substantially halted for a time period that is less than about three minutes.

7. The method of claim 1 wherein liquid flow in said dual use zone is substantially halted for a time period that is less than about two minutes.

8. The method of claim 1 wherein liquid flow in said dual use zone is substantially halted for a time period that is between about twenty and one hundred twenty (20-120) seconds.

9. The method of claim 3 wherein the volume of liquid is heated to a temperature of between about 100 and 190 degrees Fahrenheit (38 and 88 degrees Celsius).

10. The method of claim 1 wherein the counter flow in step "f" extends through multiple of the modules.

11. The method of claim 1 wherein said dual use zone includes multiple modules.

12. The method of claim 1 wherein the washing chemical is sprayed.

13. A method of washing fabric articles, comprising the steps of:

a) providing a reservoir of washing liquid;

b) providing a continuous batch washing machine having an interior for holding fabric articles and multiple modules, one module being an inlet module, one module being an outlet module, one or more modules being wash modules, one or more modules being rinse modules and one or more modules being dual use modules that function as both wash modules and rinse modules;

c) placing fabric articles to be washed in the inlet module;

d) sequentially transferring the fabric articles from one module to another module until the fabric articles travel from the inlet module to the outlet module and through the dual use modules;

e) pumping the washing liquid from the reservoir to the washing machine interior in step "d"; and f) during a first period of a particular batch time the fabric articles are spending in a particular dual use module, not flowing a rinsing liquid in the washing machine interior for a selected time interval after step "e", so that a standing bath condition is created in the particular dual use module for the fabric articles; and g) after step "f" during a second period of time of the particular batch time the fabric articles are spending in the particular dual use module pulse flowing fluid to the fabric articles for a selected time interval in one or more of the dual use modules that function as rinse modules.

14. The method of washing fabric articles of claim 13 wherein one or more finishing chemicals are added to the outlet module.

15. The method of washing fabric articles of claim 13 wherein pulse flow is added to the fabric articles in multiple of the modules.

16. The method of washing fabric articles of claim 13 wherein fluid is discharged below a water surface in step "g".

17. The method of washing fabric articles of claim 16 wherein the fluid is directed upwardly in step "g".

18. The method of washing fabric articles of claim 13 wherein fabric articles are being rinsed in one of the modules in step "g" and then transferred to the outlet module.

19. The method of washing fabric articles of claim 13 wherein pulse flow of step "g" is separated into multiple modules that are not wash modules.

20. The method of washing fabric articles of claim 13 wherein the time interval of step "f" is between about 0.5 and 1.5 minutes.

21. The method of washing fabric articles of claim 13 wherein the time interval of step "f" is between about one half and two minutes.

22. A method of washing fabric articles in a continuous batch tunnel washer, comprising the steps of:

a) providing a continuous batch tunnel washer having an interior, an intake hopper, a discharge, a plurality of modules, and a volume of liquid;

b) moving the fabric articles from the intake hopper to the discharge and through the modules in sequence;

c) wherein in step "b" multiple of the modules define a dual use zone wherein fabric articles are washed with washing chemicals and thereafter rinsed in the same modules;

d) adding a washing chemical to the volume of liquid and to the dual use zone;

e) during a first period of a particular batch time the fabric articles are spending in a particular dual use module, step "d" defines a standing bath wherein the washing chemical and volume of liquid are not further diluted;

f) after step "e", during a second period of time counter flowing a rinsing liquid in the dual use zone and along a flow path that is generally opposite the direction of travel of the fabric articles in steps "b" and "c".

23. The method of claim 22 wherein liquid flow in the dual use zone is substantially halted for a time period that is less than about five minutes.

24. The method of claim 22 wherein liquid flow in the dual use zone is halted for a time period that is less than about three minutes.

25. The method of claim 22 wherein liquid flow into the dual use zone is halted for a time period that is less than about two minutes.

26. The method of claim 22 wherein liquid flow into the dual use zone is halted for a time period that is less than about one minute.

27. The method of claim 22 wherein liquid flow into the dual use zone is halted for a time period that is less than about thirty seconds.

28. The method of claim 22 wherein liquid flow into the dual use zone is halted for a time period that is between about twenty and one hundred twenty (20-120) seconds.

29. The method of claim 22 wherein flow in the dual use zone from one module to another module is substantially halted for a time period that is less than about five minutes.

30. The method of claim 22 wherein liquid flow in the dual use zone from one module to another module is halted for a time period that is less than about three minutes.

31. The method of claim 22 wherein liquid flow in the dual use zone is halted for a time period that is less than about two minutes.

32. The method of claim 22 wherein liquid flow in the dual use zone from one module to another module is halted for a time period that is less than about one minute.

33. The method of claim 22 wherein liquid flow in the dual use zone from one module to another module is halted for a time period that is less than about two minutes.

34. The method of claim 22 wherein liquid flow in the dual use zone from one module to another module is halted for a time period that is between about twenty and one hundred twenty (20-120) seconds.

* * * * *